US008286799B2

(12) United States Patent
Malmberg

(10) Patent No.: US 8,286,799 B2
(45) Date of Patent: Oct. 16, 2012

(54) SUPPORTING STRUCTURE AND A SUPPORT CARRIER

(75) Inventor: Mats Malmberg, Rydsgård (SE)

(73) Assignee: Sandvik Intellectual Property AB, Sandviken (SE)

( * ) Notice: Subject to any disclaimer, the term of this patent is extended or adjusted under 35 U.S.C. 154(b) by 473 days.

(21) Appl. No.: 12/081,564

(22) Filed: Apr. 17, 2008

(65) Prior Publication Data

US 2008/0257791 A1 Oct. 23, 2008

(30) Foreign Application Priority Data

Apr. 19, 2007 (SE) ..... 0700952

(51) Int. Cl.
*B07B 1/49* (2006.01)

(52) U.S. Cl. ..... 209/405; 209/391; 209/399; 209/401; 209/414

(58) Field of Classification Search ..... 209/393, 209/395, 399, 403, 405, 408, 414, 373, 93; 198/399
See application file for complete search history.

(56) References Cited

U.S. PATENT DOCUMENTS

| | | | | |
|---|---|---|---|---|
| 5,112,475 | A * | 5/1992 | Henry, Jr. | 209/399 |
| 5,277,319 | A * | 1/1994 | Henry, Jr. | 209/399 |
| 5,346,053 | A * | 9/1994 | Dorn | 198/399 |
| 5,361,911 | A * | 11/1994 | Waites et al. | 209/399 |
| 5,735,409 | A | 4/1998 | Malmberg | |
| 6,267,246 | B1 | 7/2001 | Russell et al. | |
| 7,090,083 | B2 * | 8/2006 | Russell et al. | 209/405 |
| 7,264,125 | B2 * | 9/2007 | Lipa | 209/397 |
| 7,296,685 | B2 * | 11/2007 | Malmberg | 209/405 |
| 2005/0167341 | A1 * | 8/2005 | Bacho et al. | 209/405 |
| 2005/0189265 | A1 | 9/2005 | Malmberg | |
| 2006/0180509 | A1 * | 8/2006 | Burnett et al. | 209/405 |
| 2007/0000817 | A1 | 1/2007 | Malmberg | |
| 2007/0138066 | A1 | 6/2007 | Malmberg | |
| 2007/0144945 | A1 | 6/2007 | Malmberg | |

FOREIGN PATENT DOCUMENTS

| | | | |
|---|---|---|---|
| DE | 141627 | | 5/1980 |
| DE | 202 04 123 | U1 | 6/2002 |
| EP | 1 688 189 | A1 | 8/2006 |
| WO | WO 2005/077551 | A1 | 8/2005 |
| WO | WO 2006/031176 | A1 | 3/2006 |

* cited by examiner

*Primary Examiner* — Terrell Matthews
(74) *Attorney, Agent, or Firm* — Morgan, Lewis & Bockius LLP

(57) ABSTRACT

A supporting structure for different screening media on a vibrating screen is disclosed, as well as a support carrier of the supporting structure. The supporting structure is received on a vibrating screen and has a number of support carriers arranged parallel to each other and perpendicular to a number of transversal carriers. The support carriers and the transversal carriers form a grid. The support carriers have grooves at each end to be snapped on and locked on circular ribs on top of the transversal carriers. The support carriers are made of a polymeric material and are elongated elements.

21 Claims, 3 Drawing Sheets

SUPPORTING STRUCTURE AND A SUPPORT CARRIER

RELATED APPLICATION DATA

This application claims priority under 35 U.S.C. §119 and/or §365 to Swedish Application No. 0700952-5, filed Apr. 19, 2007, the entire contents of which are incorporated herein by reference.

TECHNICAL FIELD

The present disclosure concerns a supporting structure for different screening media on a vibrating screen and a support carrier used in the supporting structure.

PRIOR ART

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

In vibrating screens used for fractionation of for example crushed stones and gravel into fractions of stones with different sizes, screening media are used having screening holes for allowing stones smaller than the screening holes to pass through the holes.

Vibrating screens are known having an adapter system or a supporting structure to be able to use different types of screening media. The screening media normally have the form of a wire mesh, polymer mats, panels or modular screening elements. The supporting structure has the form of a number of elements placed in a grid supporting the screening media.

SUMMARY

A screen is relatively heavy and a general goal is always to lower the total weight whenever possible as well as to lower costs. In the different adapter systems or supporting structures for the screening media, it is common to use different parts of metal, mainly steel. By replacing such parts with polymeric parts, not only will the total weight of the screen be reduced but also one avoids possible corrosion problems. Further, by having snap on locks instead of bolts, rivets or welding, it will be easier and quicker to adapt the screen to the screening media used in a certain situation. By avoiding welding, one also avoids problems caused by welding, such as cracking due to fatigue. Depending on the type of material received, the sizes of the fractions wanted etc. . . . , it may be necessary to change the type of screening media from time to time. Thus, it should be possible to amend the set-up of the screen without having to make any major rebuilding of the screen.

One object of the presently disclosed supporting structure and support carrier is to reduce the total weight of the screen. According to the present disclosure, one way to do this is to replace parts made of steel with corresponding parts made of a polymeric material. By using a polymeric material with reinforcement it is possible to combine relatively high strength with low weight. The use of a polymeric material instead of steel further means that one also avoids problems concerning corrosion. A further object is to form a system that easily could be adapted to different situations, both concerning the material to be screened and the screening media, such as modular screening elements or wire meshes to be used. A further object is to avoid the use of bolts, rivets, welding or similar means of fastening. Still a further object is to have a more simple system.

Further objects and advantages will be obvious for a person skilled in the art, reading the detailed description below of present preferred embodiments.

An exemplary supporting structure of a vibrating screen comprises a plurality of support carriers including grooves at each end, and a plurality of transversal carriers including ribs, wherein the support carriers are arranged parallel to each other and perpendicular to the transversal carriers, wherein the support carriers and the transversal carriers form a grid, wherein the grooves of the support carriers snap on and lock on the ribs, wherein the support carriers are made of a polymeric material, and wherein the screening media are received on the grid.

An exemplary support carrier of a supporting structure of a vibrating screen comprises an elongated element, and a plurality of grooves cooperating with transversal carriers of the supporting structure to form a snap lock, wherein the support carrier is made of a polymeric material.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Figure 1:
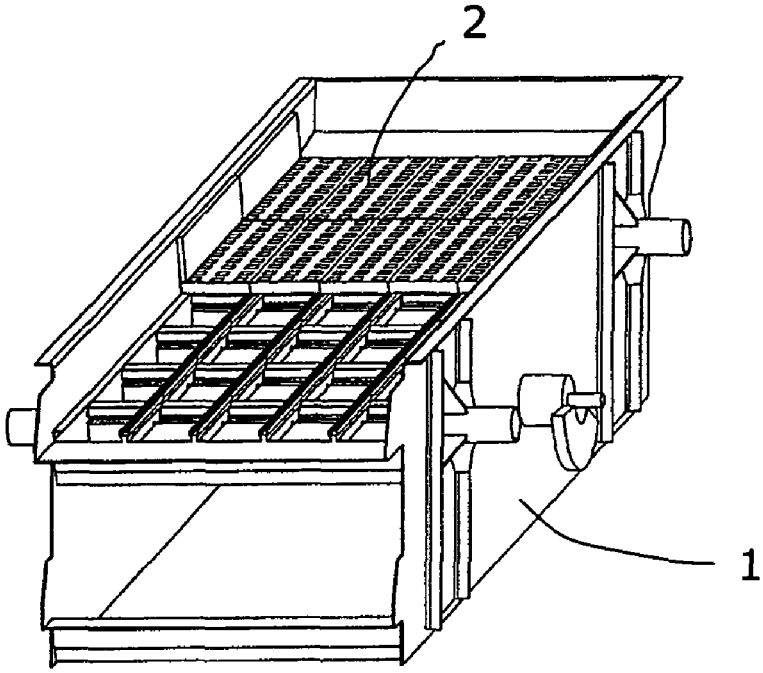
FIG. 1 is a perspective view of a screen.

As used in this description expressions like "top", "upper", "lower" and similar expressions are in view of the positions as shown in the drawings and with the normal orientation of a vibrating screen.

Figure 2:
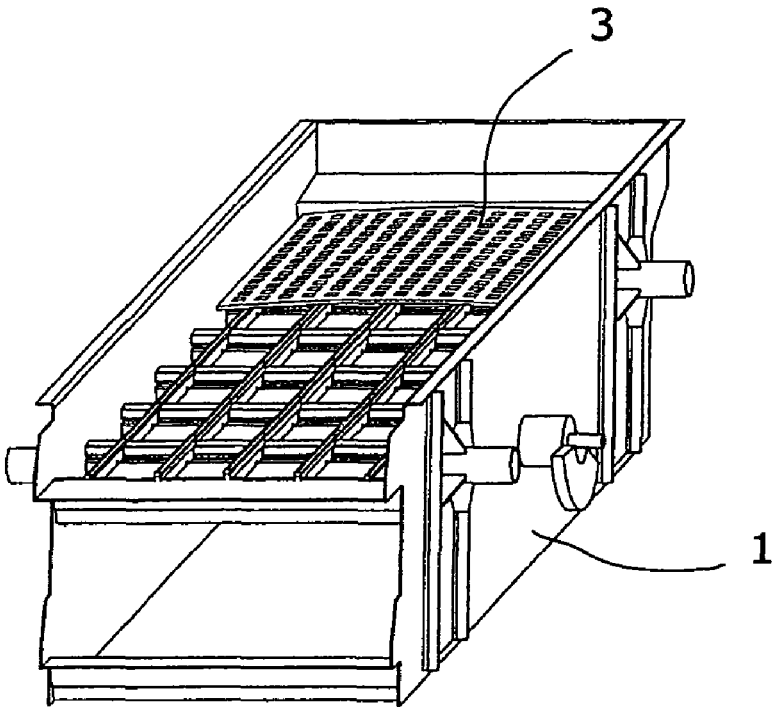
FIG. 2 is a perspective view of the screen of FIG. 1 illustrating an alternative screening media.

A vibrating screen 1 has a screen deck receiving materials to be screened, such as crushed stones, gravel etc. . . . To accomplish the screening the screen deck is vibrated. The screen deck is normally furnished with screening media formed of either a number of modular screening elements 2, a wire mesh, polymer mats 3 or panels. Wire meshes and polymer mats are often referred to as cross tension media. The screening media are received on some kind of supporting structure. If the screening media have the form of modular screening elements 2, they may be placed oriented either along or transverse to the direction of motion of the material to be screened. In the example of FIG. 1, the modular screening elements 2 are placed along the direction of motion of the material to be screened. In the example of FIG. 2, a cross tension media in the form of a polymer mat 3 is indicated. The polymer mat 3 is given a curved form.

In the shown embodiments, the supporting structure is formed of a number of transversal carriers 4, support carriers 5 and protective spacer elements 6, 23, 25. The transversal carriers 4 are placed parallel to each other and transversal to the direction of motion for the material to be screened. The transversal carriers 4 are fastened by bolting, welding or other suitable fastening means to cross members (not shown) of the vibrating screen deck. The support carriers 5 are placed parallel to each other on top of the transversal carriers 4 and perpendicular to the transversal carriers 4. The protective spacer elements 6 are normally used together with cross tension media. The spacer elements 6, 23, 25 are placed on top of the transversal carriers 4 between the support carriers 5.

The transversal carriers 4 have the form of elongated rails. In cross section, each transversal carrier 4 has a base with two stanchions 16, 17, 18, one at each side of the base. The transversal carriers 4 placed at the ends of the screen deck may have only one stanchion 19, 19*a*. In some embodiments the stanchions 18 are of similar height, while in other embodiments the stanchions 16, 17 of each transversal carrier 4 are of different heights. The stanchions 19, 19*a* of the transversal carriers 4 placed at the ends may also be of different heights. On top of each stanchion 16-19*a*, a circular rib 20 is formed. The circular rib 20 is to be received in a matching groove of parts to be placed on top of the transversal carriers 4. A person skilled in the art realizes that the exact form of the transversal carriers 4 may vary, as long as they fulfill the intended use.

Figure 3:
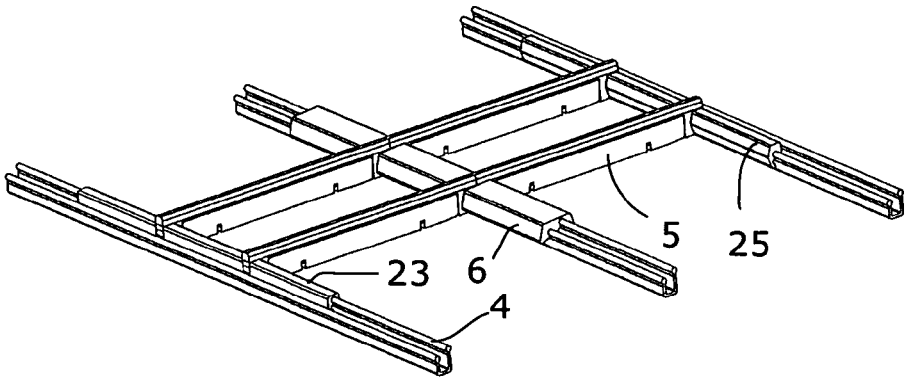
FIG. 3 is a perspective illustrative view of a supporting structure.
Figure 16:
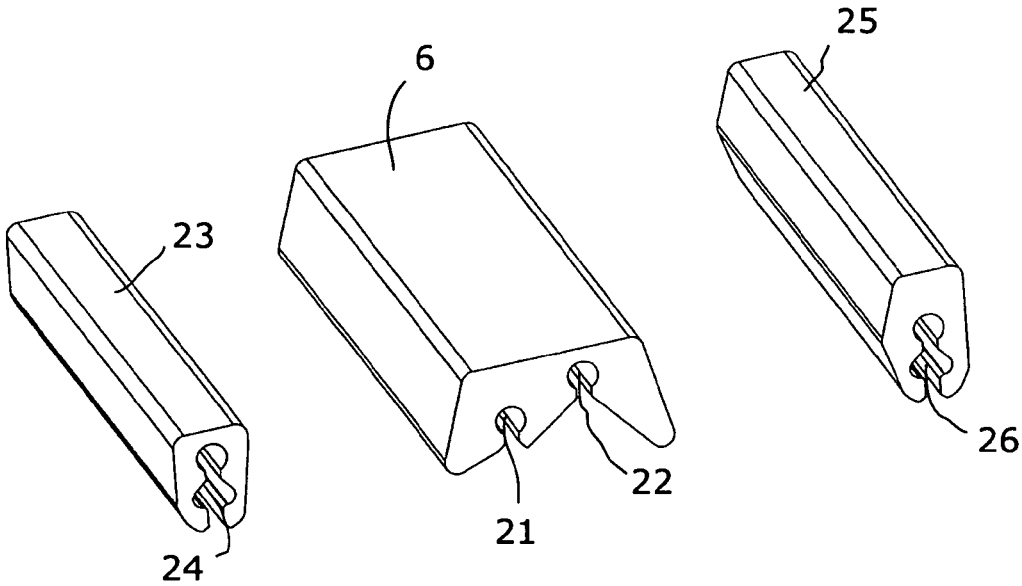
FIG. 16 is a perspective view of three different protective spacer elements.
Figure 4:
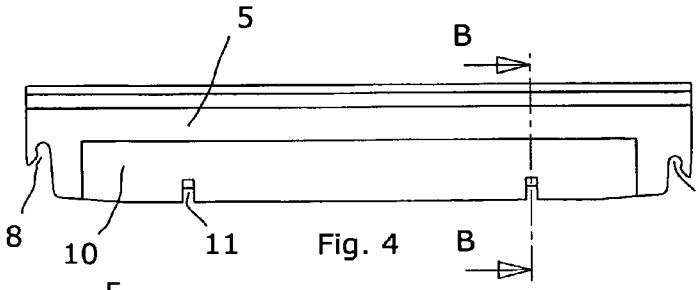
FIG. 4 is a side view of a support carrier.
Figure 5:
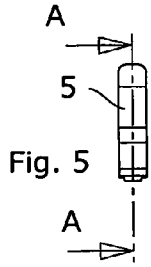
FIG. 5 is an end view of the support carrier of FIG. 4.
Figure 7:
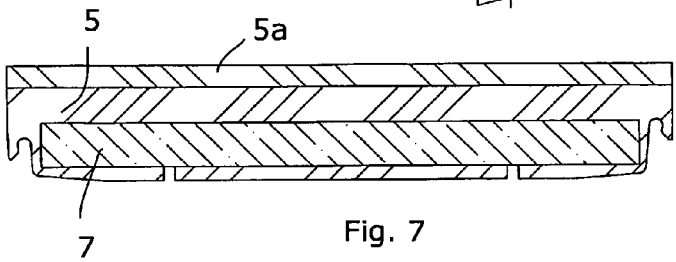
FIG. 7 is a longitudinal section taken at the line A-A in FIG. 5.
Figure 6:
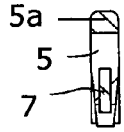
FIG. 6 is a cross section taken at the line B-B in FIG. 4.

The support carriers 5 are elongated, relatively thin elements having a generally rectangular cross section. The support carriers 5 are made of a polymeric material, for example polyurethane. At each end of each support carrier 5, a groove 8, 9 is formed for cooperation with the circular ribs 20 of the transversal carriers 4. The grooves 8, 9 have a generally vertical orientation and open towards the lower side of each support carrier 5. Thus, the grooves 8, 9 of the support carriers 5 will form a snap lock with the circular ribs 20 on top of the stanchions 16-19 of the transversal carriers 4. The positions and depths of the grooves 8, 9 of the support carriers 5 are adapted to the form of the transversal carriers 4 to receive said support carriers 5. As reinforcement and to increase the stiffness of the support carriers 5, a reinforcing rib 7 is placed inside each support carrier 5. The reinforcing ribs 7 are preferably made of a composite, e.g. fibreglass, or aramid. The reinforcing ribs 7 are placed in the support carriers 5 during moulding or are glued to the support carriers 5. The grooves 11 shown in the FIGS. 3 and 6 at the bottom of the support carriers 5 are used in the manufacturing process. To save weight and material, the support carriers 5 have a thinner part or indentation 10 placed at the lower part of each support carrier 5. One indentation 10 is formed on both opposing sides of each support carrier 5. The support carriers 5 have the full width, seen in cross section, at the top and at each end. Thus, the support carriers have full width in the area of the grooves 8, 9 for cooperation with the circular ribs 20 of the transversal carriers 4.

In some embodiments the upper part 5*a* of the support carriers 5 is made of a softer material. In other embodiments a capping in form of a polymeric strip is placed on top of each support carrier 5.

Figure 8:
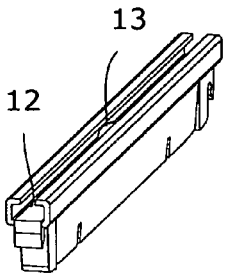
FIG. 8 is a perspective view of one example of a support carrier.
Figure 9:
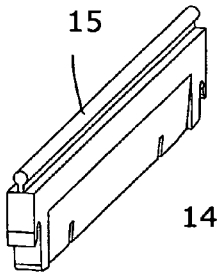
FIG. 9 is a perspective view of an alternative support carrier.
Figure 10:
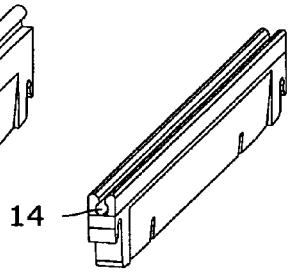
FIG. 10 is a perspective view of an alternative support carrier.
Figure 11:
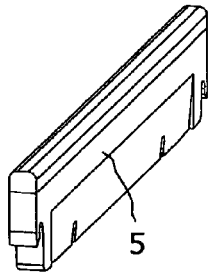
FIG. 11 is a perspective view of a further alternative support carrier.
Figure 12:
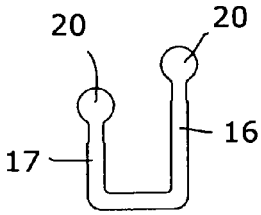
FIG. 12 is an end view of one example of a transversal carrier.
Figure 13:
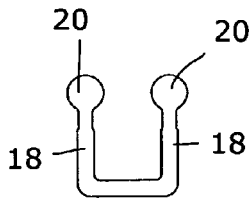
FIG. 13 is an end view of a second example of a transversal carrier.
Figure 14:
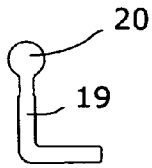
FIG. 14 is an end view of a further example of a transversal carrier.
Figure 15:
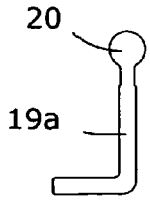
FIG. 15 is an end view of yet a further example of a transversal carrier.

The top of the support carriers 5 has different shape depending on the type and make of the screen 1 and the screening media used. Some different shapes of the top of the support carriers 5 are indicated in FIGS. 8-11. In the example of FIG. 8, the top is a rail profile 12, having side parts extending outside the support carriers 5, seen in cross section, and forming a longitudinal groove. In this example a central bulge 13 is indicated. The bulge 13 is intended for cooperation with an opening in a modular screening element 2, whereby the modular screening elements 2 will be correctly orientated and any tendency to movement of the screening media will be counteracted. Normally the bulge 13 is placed centrally on each support carrier 5, seen in longitudinal direction. In other embodiments, each support carrier has two or more bulges placed along the upper surface of the support carrier. In another example, the top of the support carriers 5 is a straight surface (FIG. 11), in other examples it is a groove profile 14 (FIG. 10) or a bar profile 15 (FIG. 9) in the form of a circular rib. Independent of the shape of the top of the support carrier 5, at least one bulge 13 is normally arranged. The bulge(s) 13 is placed on top of the support carrier 5, in the rail profile 12, in the groove profile 14 or on top of the bar profile 15. To give a wire mesh or other tensioned or pre-tensioned screening media of the screen deck an arched surface, if wanted, support carriers 5 of different height are normally used.

The spacer elements 6, except the spacer elements 23, 25 placed at the ends of the screen deck, have two longitudinal grooves 21, 22 on the lower surface. The grooves 21, 22 are formed for cooperation with the circular ribs 20 of the stanchions 16-18 of the transversal carriers 4. Depending on the height of the stanchions 16-18 the grooves 21, 22 have different depths. Spacer elements 23, 25 to be placed on transversal carriers 4 at the ends of the screen deck have only one groove 24, 26 for cooperation with a circular rib 20 on a single stanchion 19, 19*a* of a transversal carrier 4. The spacer elements 23, 25 to be placed at the ends of the screen deck are shown having different heights. In the shown examples, the higher of the spacer elements has inclined surfaces on the side facing the screen deck. Thus, there will be a snap lock between the grooves 21, 22, 24, 26 of the spacer elements 6, 23, 25 and the circular ribs 20 of the transversal carriers 4. The spacer elements 6, 23, 25 are normally placed abutting two adjacent support carriers 5.

In use, a number of transversal carriers 4 are first placed in equal spacing to start forming the supporting structure. The transversal carriers 4 are fixed to the screen as indicated above. Then, a number of support carriers 5 are placed on the transversal carriers 4 in a spacing adapted to the width of the screen. The support carriers 5 are placed parallel to each other and perpendicular to the transversal carriers 4, to form a grid. The spacing between the transversal carriers 4 and support carriers 5, respectively, depends inter alia on the intended use of the screen 1, the screening media and the material to be screened. The exact shape, i.e., the cross section, of the support carriers 5 are chosen depending on the type of modular screening elements 2, wire mesh 3 or other screening media to be used. The support carriers 5 are placed on the transversal carriers 4 with the ends of adjacent support carriers abutting each other. Each support carrier 5 is placed with its ends on two adjacent transversal carriers 4. The grooves 8, 9 of the support carriers 5 cooperate with the circular ribs 20 of the stanchions 16-19*a* of the transversal carriers 4 to form snap locks. The support carriers 5 are placed parallel to each other and perpendicular to the transversal carriers 4. Concurrent with the placement of the support carriers 4 the protective spacer elements 6, 23, 25 are placed between the support carriers 5 and on top of the transversal carriers 4. The length of the spacer elements 6 are adapted to the distance between the support carriers 5 and normally the ends of the spacer elements will abut the support carriers 5. The grooves 21, 22, 24, 26 of the spacer elements 6 cooperate with the circular ribs 20 of the stanchions 16-19*a* of the transversal carriers 4, to form snap locks. Finally, a wire mesh 3, modular screening elements 2 or other screening media are placed on the supporting structure formed of the transversal carriers 4, the support carriers 5 and the spacer elements 6.

Depending on type and brand of the modular screening elements 2 and their orientation a number of support carriers 5 and spacer elements 6 may be taken away to receive the modular screening elements 2. The modular screening elements 2 are either snapped on to the support carriers 5 or the transversal carriers 4, depending on the orientation of the modular screening elements 2.

The modular screening elements 2 are placed oriented either along or transversal to the direction of motion of the material to be screened. When the modular screening elements 2 are oriented along the direction of motion of the material to be screened they are placed on the support carriers 5. When the modular screening elements 2 are oriented transversal to the direction of motion of the material to be screened they are placed directly on the transversal carriers 4, thus no support carriers 5 or spacer elements 6 are needed in that case. Openings in the screening elements 2 are normally placed to receive bulges 13 of the support carriers 5.

In use it is possible to have both cross tension media and modular screening elements on the same vibrating screen. It is also possible to have different types of modular screening elements or different types of cross-tensioned screening media.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A supporting structure of a vibrating screen, comprising
- a plurality of support carriers including grooves at each end; and
- a plurality of transversal carriers including ribs,
- wherein the support carriers are arranged parallel to each other and perpendicular to the transversal carriers,
- wherein the support carriers and the transversal carriers form a grid,
- wherein the grooves of the support carriers snap on and lock on the ribs,
- wherein the support carriers are made of a polymeric material,
- wherein screening media are received on the grid,
- wherein the transversal carriers have a base part with one or two stanchions, and
- wherein the ribs to be received in the grooves of the support carriers are placed on top of the stanchions.

2. The supporting structure of claim 1, wherein the support carriers are made of polyurethane.

3. The supporting structure of claim 1, comprising a reinforcing rib inside each support carrier.

4. The supporting structure of claim 3, wherein the reinforcing rib is made of a composite.

5. The supporting structure of claim 3, wherein the composite is fibreglass or aramid.

6. The supporting structure of claim 1, wherein the support carriers have different heights.

7. The supporting structure of claim 1, wherein the support carriers have a rectangular cross section form.

8. The supporting structure of claim 7, wherein the support carriers have a cross section forming a rail, a groove or a bar at the top.

9. The supporting structure of claim 1, wherein at least one bulge is formed for cooperation with an opening of a part received on the supporting structure.

10. The supporting structure of claim 1, comprising protective spacer elements are placed between and abutting adjacent support carriers and sides of the vibrating screen.

11. The supporting structure of claim 1, wherein the stanchions of the transversal carriers have different heights.

12. The supporting structure of claim 1, wherein the supporting structure receives tensioned media.

13. The supporting structure of claim 1, wherein the supporting structure receives a number of modular screening elements placed on the transversal carriers and arranged perpendicular to the general direction of motion of material on the screen.

14. The supporting structure of claim 1, wherein the supporting structure receives both cross tension media and one or more different types of modular screening elements.

15. A support carrier of a supporting structure of a vibrating screen, comprising
- an elongated element;
- a plurality of grooves in the elongated element cooperating with a plurality of transversal carriers of the supporting structure to form a snap lock, each of the plurality of grooves having a generally vertical orientation and open towards a lower end of the elongated element;
- a reinforcement inside the support carrier; and
- indentations on opposite sides of a lower part of the support carrier,
- wherein the support carrier is made of a polymeric material and
- wherein the support carrier has a cross section forming a rail, a groove or a bar at a top.

16. The support carrier of claim 15, wherein the polymeric material is polyurethane.

17. The support carrier of claim 15, wherein the reinforcement is a reinforcing rib made of a composite.

18. The support carrier of claim 17, wherein the composite is fibreglass or aramid.

19. The support carrier of claim 15, wherein the support carrier has a rectangular cross section form.

20. The support carrier of claim 15, wherein at least one bulge is formed on each support carrier, either at the top or inside the rail or the groove at the top.

21. The support carrier of claim 15, wherein an upper part is made of a softer material than a remainder of the support carrier.

* * * * *